US008454236B2

(12) United States Patent
Ramirez

(10) Patent No.: US 8,454,236 B2
(45) Date of Patent: Jun. 4, 2013

(54) BAG FOR STORING AND TRANSPORTING GAME AND MEAT

(76) Inventor: Ted Raymond Ramirez, Centennial, CO (US)

( * ) Notice: Subject to any disclaimer, the term of this patent is extended or adjusted under 35 U.S.C. 154(b) by 390 days.

(21) Appl. No.: 12/759,529

(22) Filed: Apr. 13, 2010

(65) Prior Publication Data

US 2010/0260443 A1 Oct. 14, 2010

Related U.S. Application Data

(60) Provisional application No. 61/169,202, filed on Apr. 14, 2009.

(51) Int. Cl.
*B65D 33/16* (2006.01)
*B65D 33/28* (2006.01)

(52) U.S. Cl.
USPC ..... 383/61.4; 383/75; 383/76

(58) Field of Classification Search
USPC ..... 383/75, 24, 14, 16, 72, 73, 76, 8, 383/22, 61.4; 70/65
See application file for complete search history.

(56) References Cited

U.S. PATENT DOCUMENTS

| | | | | | |
|---|---|---|---|---|---|
| 1,920,824 | A * | 8/1933 | West | 383/75 |
| 2,186,384 | A * | 1/1940 | Lester | 383/72 |
| 2,788,822 | A * | 4/1957 | Parker | 206/554 |
| 3,674,188 | A * | 7/1972 | Anderson | 224/603 |
| 5,238,305 | A * | 8/1993 | Feller | 383/22 |
| 5,238,307 | A * | 8/1993 | Mooney et al. | 383/74 |
| 5,349,966 | A * | 9/1994 | Garcia | 128/879 |
| 5,467,907 | A * | 11/1995 | Celik | 224/103 |
| 7,160,028 | B1 * | 1/2007 | Linday | 383/4 |
| 7,370,660 | B2 * | 5/2008 | Hamilton et al. | 135/67 |
| 2003/0128897 | A1 * | 7/2003 | Lehrman | 383/2 |
| 2004/0156564 | A1 * | 8/2004 | Glasser | 383/72 |
| 2006/0153477 | A1 * | 7/2006 | Koguchi | 383/14 |
| 2010/0284631 | A1 * | 11/2010 | Lee | 383/12 |

FOREIGN PATENT DOCUMENTS

| | | | |
|---|---|---|---|
| JP | 2005218724 | A * | 8/2005 |
| JP | 2007313258 | A * | 12/2007 |

* cited by examiner

*Primary Examiner* — Jes F Pascua
(74) *Attorney, Agent, or Firm* — Kyle W. Rost

(57) ABSTRACT

A game bag defines an open mouth ringed by a drawstring passage. Suspending loops are sewn into stitching forming the drawstring passage and are positioned near opposite side edges of the bag. Light reflective loops are carried at a side edge and in a bottom seam near an opposite side edge.

7 Claims, 4 Drawing Sheets

BAG FOR STORING AND TRANSPORTING GAME AND MEAT

CROSS-REFERENCE TO RELATED APPLICATION

This application claims the benefit of U.S. Provisional Patent Application Ser. No. 61/169,202 filed Apr. 14, 2009, copending.

BACKGROUND OF THE INVENTION

1. Field of the Invention

The invention generally relates to flexible bags. More specifically, the invention relates to a hunter's storage bag for game. The invention is a portable game, fowl, and fish storage bag, particularly useful for storing, transporting and preserving meat quarters and parts of the meat after harvesting, field dressing and butchering into manageable portions. The bag is sized to house fish or harvested game animal and fowl portions.

2. Description of Related Art Including Information Disclosed Under 37 CFR 1.97 and 1.98

Hunters and fishermen face the problem of protecting and preserving their game, as well as keeping their game safe and sanitary. In addition, hunters often face a difficult task in transporting large game from the field to the camp and then to a final destination. A game bag is an aide to protecting and transporting game. While still in the field, the hunter can reduce a large kill to quarters or to whatever reduction the hunter desires. The smaller portions can be stored in game bags and more conveniently carried to the camp.

A standard game bag is made of cotton canvas or a similar, strong but inexpensive fabric. Manufacturing game bags from inexpensive fabrics has practicality because the game bags might have a short life due to use in hard conditions, soaking up blood, and otherwise becoming damaged and contaminated. However, such game bags present inherent problems in use. Fabrics like canvas retain moisture, stain easily, and tend to shrink. The inadequate properties of game bags made of heavy cotton canvas drive the need for an improved game bag of new design with different material properties.

Common canvas game bags are well known for strength but equally well known for inability to dry out. The type of cotton canvas that is used in such bags is known to stay wet for hours. It is crucial for a game bag to dry or at least to substantially reduce its retained moisture so that the meat stored in the bag can remain edible for a long period of time. Wet cotton readily will allow bacteria to grow, thus leading to rapid spoilage, inevitably rendering the meat inedible.

The weight of cotton canvas is approximately ten times that of certain synthetic fabrics. Retained weight from moisture or blood is undesirable because it adds difficulty in handling and transportation. The retained weight can increase transportation expense under current air transport weight restrictions. In the field, the retained weight is a disadvantage because it adds to the weight of the hunter's pack. Cotton fabric used in canvas is also known to shrink, as this is a natural property of the cotton. In addition, cotton is known for its stain retaining abilities. It would be desirable for a game bag to avoid retaining weight and to minimize any tendency to stain, retain moisture, or shrink.

Keeping the game sanitary is important because the ultimate purpose of the harvest is for human consumption. In the field, after a game animal is harvested or the fish is caught, it is gutted, and cleaned. Then the game is stored by covering the surface with cloth. The game can be inserted into a game bag, which serves to cover the game during storage, or the game can be wrapped in cheesecloth. The cloth bag or other fabric enclosure must be breathable, but without being so permeable as to allow insects to contact the meat and to lay their eggs on it or to contaminate the meat with urine, feces, dirt, and debris. It would be desirable to have a suitable game bag that meets these requirements while enabling the hunter or fisherman to transport the bag with its meat content from the field to the butcher and home.

In many hunting situations, the game must be stored in camp for the duration of the hunting trip. This may be a period of several days and nights. Wherever predators are located, and especially in bear and wolf country, the stored meat presents a special danger because it attracts the predators. Hunters try to anticipate such danger by hanging the game, perhaps in a game bag, at a distance from camp. However, even with the game stored at a distance, the hunter faces danger because he does not know when a predator will be present. A hunter may pass near the stored game when leaving from or returning to camp, or simply when he is moving about the area at night without considering that he is near the stored game.

In some states, the law provides that game meat should not be wasted. Such a mandate can be interpreted to mean that the hunter should protect the harvested game from contaminants and predators. Hunters often check on the stored game during the night to defend it against the possibility that a predator is claiming the game bag and its contents. Even a hunter who is considering that a predator might be present can be surprised. It would be desirable for a game bag to help alert the hunter when a predator is present.

To achieve the foregoing and other objects and in accordance with the purpose of the present invention, as embodied and broadly described herein, the method and apparatus of this invention may comprise the following.

BRIEF SUMMARY OF THE INVENTION

A general object of the invention is to provide a game storage bag formed of pliable cloth having properties suitable for receiving raw meat and maintaining the meat within a protective shield that is adequate for keeping the meat clean and free of debris and insects during storage in the field and during transportation.

Another object is to provide a game storage bag that provides the hunter with early warning of when a predator is present. The outer visible portion of the bag has two permanent attached reflective ribbons. The ribbon is sewn into the seam at one side of the bag and the other is sewn in the bottom seam of the bag. This ribbon is bright florescent in color so that it is easily identified from a distance. The ribbon also has light reflective properties so that it will be readily visible at night, by the light of a flashlight from a substantial distance.

A further object is to provide a game storage bag that preserves and protects the game meat from premature spoilage and contamination while aiding the use of the bag to store and transport the game meat. The bag is formed of a fabric that is uniquely light, breathable, durable and strong. The fabric can be a nylon material. The bag is sewn to have two loops that protrude from opposite sides of the mouth of the bag. The loops allow the bag mouth to be opened with ease for inserting game. The loops provide attachment points for attaching an identification tag. Similarly, a locking device can be engaged in the loops to secure the bag mouth in closed position. A suitable locking device might be a simple and inexpensive wire, string, plastic wire tie. With a locking device in place through the loops, the game bag is closed and ready for transport to a destination, such as for butchering. The closed bag is effective for keeping out contamination, debris, and insects.

Still another object is to provide a game bag that is suited to retain hosted insects within the bag. Fur and feather bearing animals are known to carry hosted parasites such as fleas and ticks. The bag is formed of a tight enough weave that it assists the user by containing these parasites until a suitable time for removing the fur or feather bearing animal and safely handling such parasites.

According to the invention, a game bag for storing and transporting game or meat is formed of front and back fabric panels joined along opposite first and second side edges and a bottom edge. The bag defines an internal cavity with an open top providing access for inserting and removing contents such as game, which may include fish and fowl. A drawstring passage is formed in the front and back panels, juxtaposed to the open top for receiving a drawstring to selectively open and close the top by interaction with the drawstring passage. The drawstring passage defines a passage opening. A drawstring is engaged in the drawstring passage and extends from the passage opening for selectively closing the open top. First and second suspending loops are attached near the open top at opposite sides thereof.

A further aspect of the invention provides for a game bag that is formed of front and back fabric panels that are continuous along the first side edge. The front and back fabric panels are joined together along the second side edge and bottom edge by stitching. The drawstring passage is formed by a folded over top edge of the fabric panels such that the drawstring passage defines the passage opening at the second side edge and is continuous around the continuous first side edge of the panels. Thus, the drawstring extends from the passage opening at the second side edge.

The game bag includes a first light reflective member carried in the stitching of the second side edge below the second suspending loop for providing reflection at night. Additionally, the game bag includes a second light reflective member carried in the stitching of the bottom edge near the first side edge and below the second suspending loop for providing reflection at night. Further, the first and second light reflective members are florescent for providing high visibility by day. The fabric panels forming the game bag are formed of nylon, preferably without other fabric content, so that the bag dries quickly, does not retain water, and resists staining.

According to a further aspect of the invention, a game bag for storing and transporting game or meat is formed of front and back fabric panels joined along opposite first and second side edges and a bottom edge, defining an internal cavity with an open top providing access for inserting and removing contents. A drawstring passage is formed in the front and back panels, juxtaposed to the open top for receiving a drawstring to selectively open and close the top by interaction with the drawstring passage, and defining a passage opening. A drawstring is engaged in the drawstring passage and extends from the passage opening for selectively closing the open top. First and second suspending loops are attached near the open top at opposite sides thereof. The drawstring passage is formed by a folded over top edge of the front and back fabric panels. The folded over top edge is stitched against the respective panel to define the drawstring passage. The first suspending loop is attached to the front fabric panel by being sewn into the stitching of the drawstring passage on the front panel in a position juxtaposed to the first side edge. The second suspending loop is attached to the back fabric panel by being sewn into the stitching of the drawstring passage on the back panel in a position juxtaposed to the second side edge. A first light reflective member is carried in the stitching of the second side edge below the second suspending loop for providing reflection at night. A second light reflective member is carried in the stitching of the bottom edge near the first side edge and below the first suspending loop for providing reflection at night. Consequently, the game bag is suspendable from the first and second suspending loops with the first and second side edges and first and second light reflective members in approximate vertical alignment with a suspending loop.

In such a game bag, the drawstring passage is formed by a folded over top edge of the front and back fabric panels. The folded over top edge is stitched against the respective panel to define the drawstring passage. The first suspending loop is attached to the front fabric panel by being sewn into the stitching of the drawstring passage on the front panel in a position juxtaposed to the first side edge. The second suspending loop is attached to the back fabric panel by being sewn into the stitching of the drawstring passage on the back panel in a position juxtaposed to the second side edge. Consequently, the game bag is suspendable from the first and second suspending loops with tendency to draw together the front and back panels of the bag.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
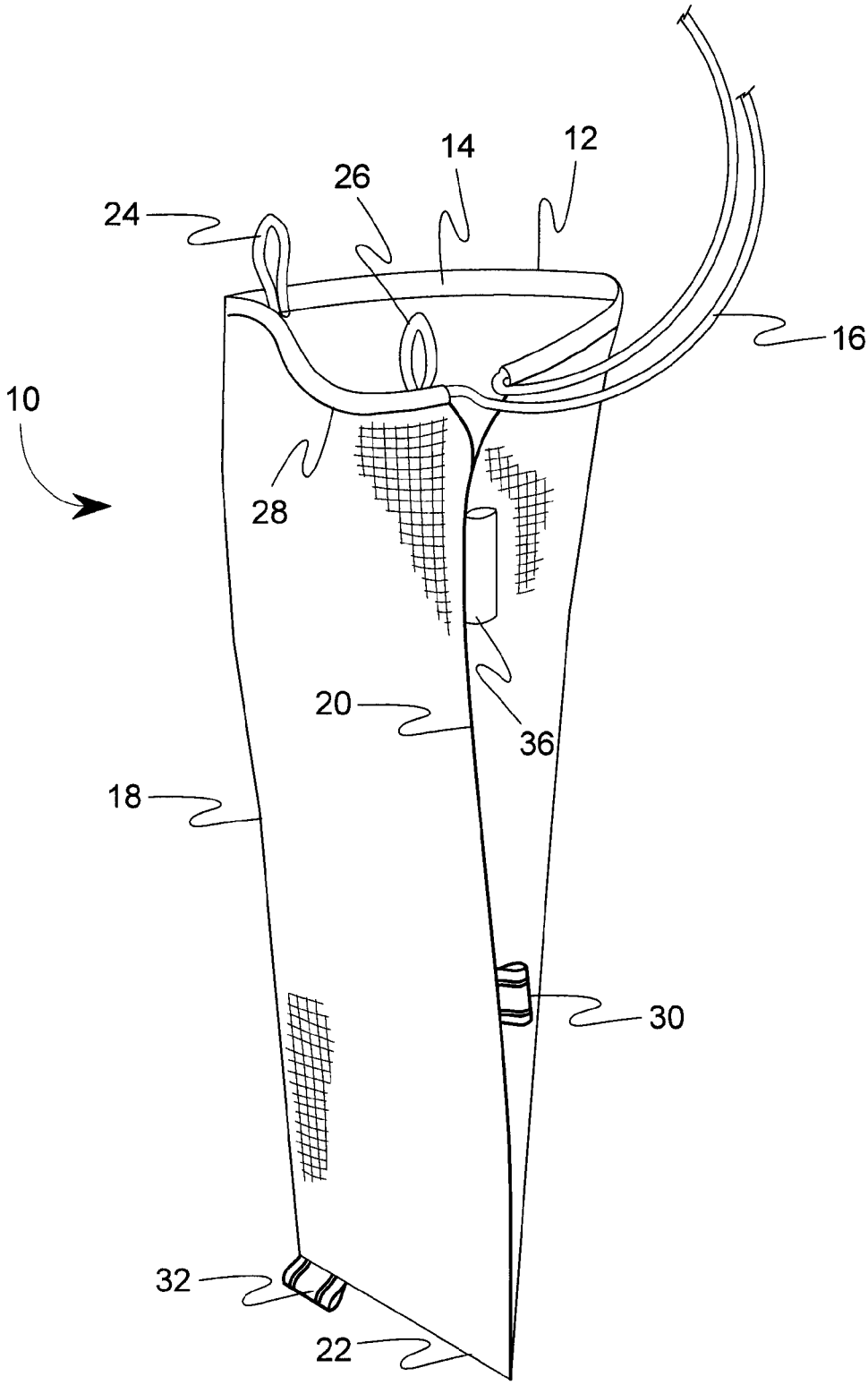
FIG. 1 is a left side elevational view of a game bag, oriented with the mouth at the top and in open position.

The invention is a portable game storage bag 10, which is suited for use with all types of game, including fowl and fish. The bag 10 is especially suited for use as a storage bag in the field. The bag 10 is an aid in storing, transporting and preserving meat quarters and parts of the meat after harvesting, field dressing and butchering into manageable portions. The bag defines an internal cavity having an open mouth for insertion of game or meat. The open mouth is selectively closable by a drawstring and is biased toward closed position by placement of suspending loops at the top of opposite major faces of the bag.

With reference to the drawings, the game storage bag 10 is formed as a pouch with opposite front and rear major faces and an open mouth 12, which typically is at the top of the bag. The bag can be formed from as little as a single, rectangular sheet of fabric, which preferably is a synthetic fabric that does not retain water. A suitable fabric is nylon. The size of the fabric sheet is preselected according to the desired size of the finished game bag. Thus, game bags may be produced in a variety of sizes to accommodate different sizes of game to be stored.

Construction using synthetic fabric content such as nylon is desirable because this content allows the material to have many attributes similar to lightweight cotton. However, unlike cotton the nylon fabric dries with ease in cool conditions whereas cotton stays wet for a longer period of time, thus prompting bacteria growth. Unlike cotton, nylon fabric does not shrink when washed and does not retain stains of blood, dirt or contaminants. The properties of the selected nylon fabric differ from other bags on the market, many of which are created of blends of polyester and cotton, elastic blends of cotton, pure cotton and variations of nylon. Nylon is a versatile fabric and can be produced in variations. Nylon fabric of the game bags 10 is marketed as being breathable, soft to the touch like cotton, as well as very strong and durable for its weight. Equivalently sized canvas bags have far greater weight.

Unlike cotton, nylon will not retain water as the water is wicked away from the meat and settles towards the direction of gravitational pull according to where the bag is placed for storage. Over a short period of time, the water will run down from the upper portions of the bag. Rapid drainage and drying are natural properties of nylon that allow the bag to dry in a short period of time.

After the size of fabric has been selected and cut, one edge of the fabric, which can be described as the top edge of the fabric, is folded over and sewn or hemmed to form a passage 14 for a drawstring 16. Where a single sheet of fabric forms the entire bag, the fabric rectangle is folded over itself along a center line that is approximately at a right angle to the top edge, thereby causing the fold line to become a first side edge 18 of the pouch. Opposite free ends of the fabric are sewn together to form a second, opposite side edge 20. The drawstring passage opens at the second, sewn side edge, allowing the drawstring to be pulled at the second side edge. The bottom end of the fabric, between the opposite side edges, is sewn together to form a closed bottom seam 22 of the pouch. Thus, a fabric rectangle is formed into an approximately rectangular bag or pouch, and an open top that houses a drawstring 16, which exits the passage 14 toward the sewn, second edge 20.

In an alternative construction, the bag may be formed of two independent panels of fabric, with a separate one forming each of the two major faces of the bag. In this alternative, edge 18 is sewn together at the meeting of two panels rather than being a continuous, folded edge. Each panel might be sewn to provide a drawstring passage opening at both edges. While this configuration of the drawstring passage is adequate, it is more desirable that the drawstring extend at only one side edge. Such a one-sided drawstring arrangement is durable because it allows the fabric of the drawstring passage to align with the drawstring if the bag is hung from the drawstring. Consequently, the drawstring passage would have reduced tendency to tear. Therefore, if two independent panels are used, they should be sewn together to eliminate a passage opening at the first edge, preserving the passage openings at the second edge.

Figure 2:
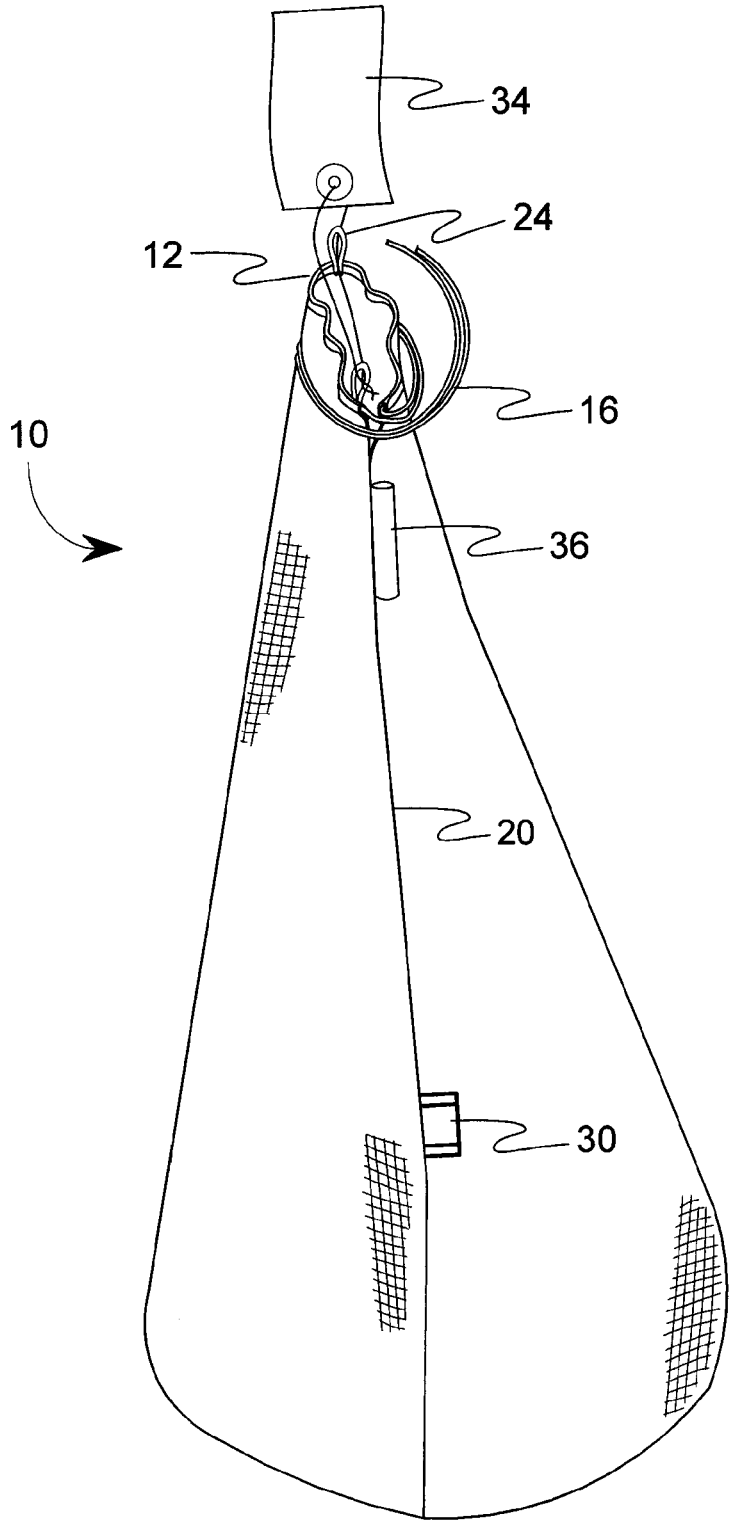
FIG. 2 is a view similar to FIG. 1, with the bag mouth in closed position and with the bag expanded as if containing game.

Drawstring 16 provides a means for closing mouth 12. In the drawing, the drawstring is shown with abbreviated ends. The full length of the drawstring is sufficient that mouth 12 can be fully open while a portion of drawstring 16 remains extending from passage 14. As suggested by FIG. 2, the drawstring can be pulled tight to close the bag mouth 12. The drawstring is pulled by holding it in one hand and pushing the bag away from the one hand holding the drawstring. After the drawstring is pulled, exposed lengths of the drawstring can be wrapped around the bag at mouth 12 to further secure the bag mouth. The free ends of the drawstring can be tucked behind a portion of the wrapping to secure the bag mouth in closed position. Opposite ends of drawstring 16 can be knotted together to prevent the drawstring from being pulled from the passage 14 and to simplify handling the ends. Alternatively, a cord lock 23, FIG. 4, may be applied to the drawstring to secure the drawstring in pulled tight position. The filled bag 10 can be hung by wrapping a rope around the closed mouth.

In order to adapt the bag to the special needs of a game storage bag, suspending loops 24, 26 are attached to the bag. Two suspending loops are desirable, and these may be located at approximately opposite positions across the bag mouth 12. The loops may be formed of cord, rope, or the like, which is sewn into the seam 28 forming the drawstring passage 14. According to the scheme shown in the drawings, a first suspending, cord loop 24 is attached at or near the fold line or first edge 18, and the second suspending, cord loop 26 is attached near an open end of the drawstring passage 14. For convenience, the loops are attached at the time when seam 28 is being sewn to form the drawstring passage, which conveniently can be while the fabric panel is open, before the fabric is folded at centerline 18. Loop 24 may be sewn in juxtaposed position to the folded first edge 18, while loop 26 may be sewn in juxtaposed position to seamed, second edge 20.

Figure 3:
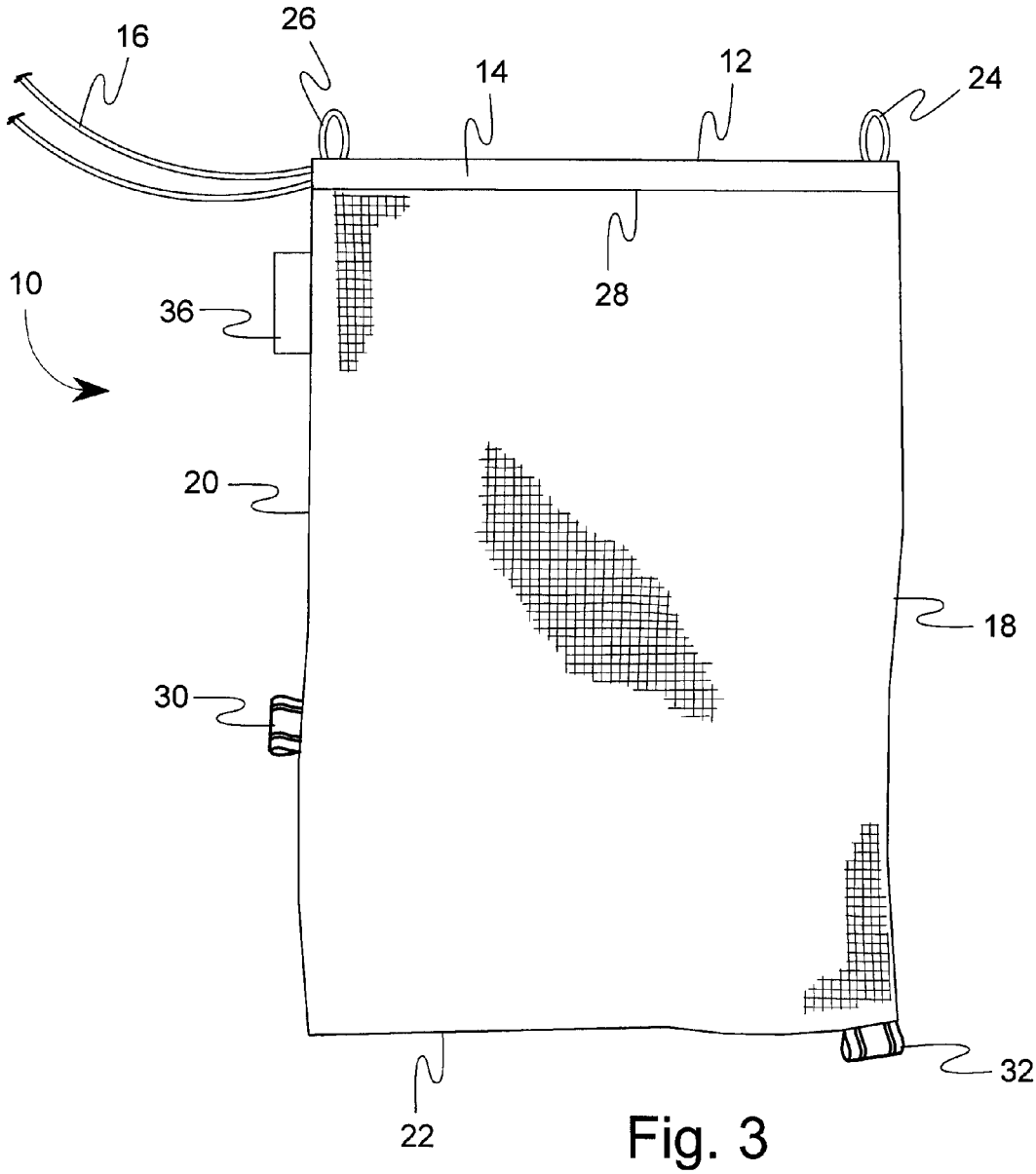
FIG. 3 is a front elevational view thereof.
Figure 4:
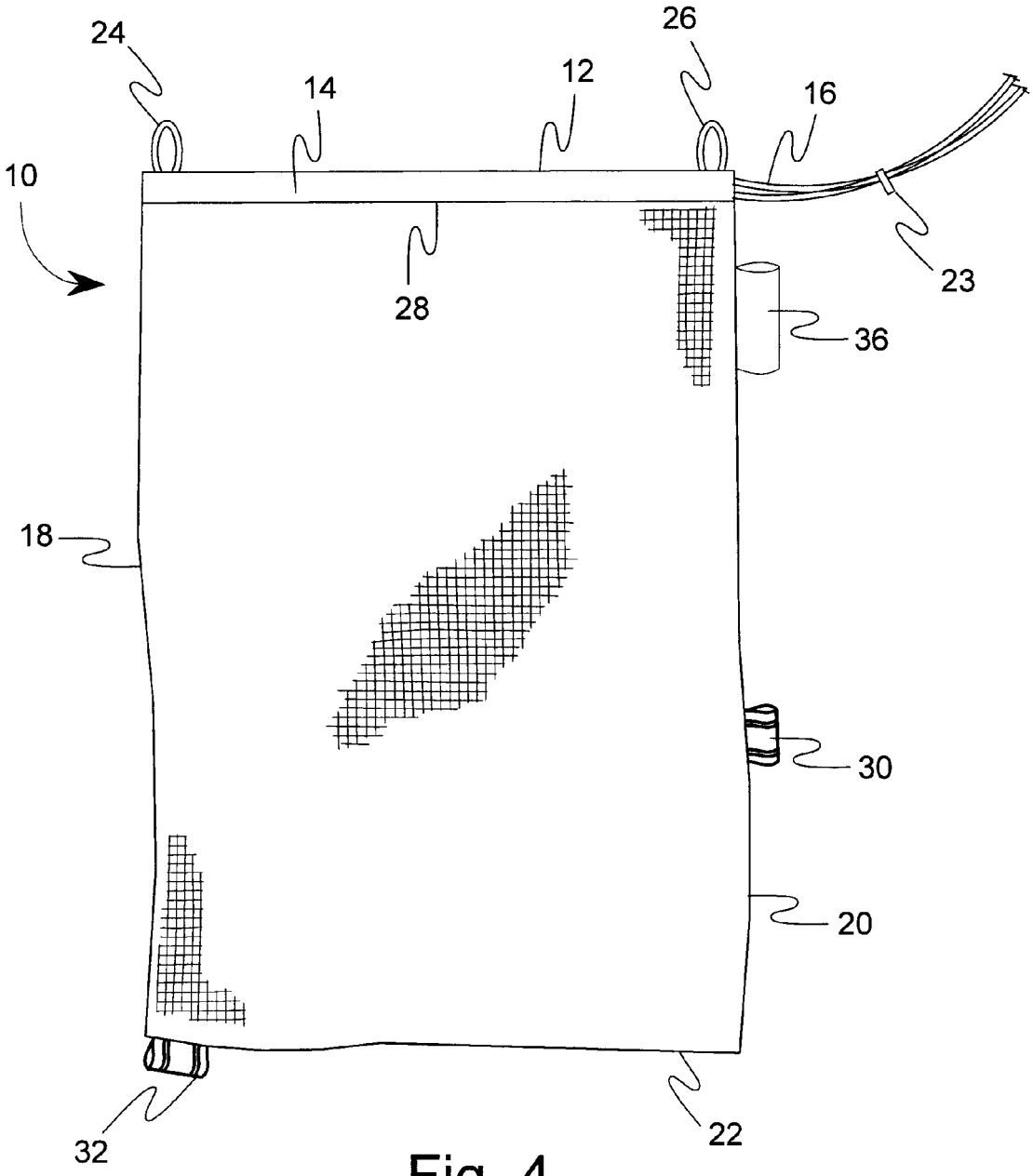
FIG. 4 is a rear elevational view thereof.

The cord loops 24, 26 provide a means for hanging the bag, such as when a wet bag is hung to dry. The loops are large enough to receive a rope or other suspending member suited to hang the bag. Thus, each loop 24, 26 has a central opening of about an inch diameter or more, which is adequate to receive a rope. For added strength to enable the loops to carry the weight of the wet bag, the loops are folded under with the fabric when forming the hem for the drawstring passage, such that the sewing of the hem passes through each loop at two or more levels or layers. When the bag 10 is in a flat position as shown in FIGS. 3 and 4, one loop is sewn into the hem of the front panel, while the other is sewn into the hem of the back panel. With this disposition, when a rope passes through the two loops to hang the bag, the two loops have an inherent tendency to draw together the front and back panels of the bag.

Another adaptation of the bag 10 is the addition of reflective element such as a reflective ribbon to one or more seams of the bag. For example, a loop 30 of reflective ribbon is sewn into side seam 20 near the center or lower half of the bag height. A loop 32 of reflective ribbon is sewn into bottom seam 22 near the intersection with side 18. The suggested placements of the ribbon loops 30, 32 provide a reflective element near each side of bag 10, such that at least one of the reflective elements is likely to be visible from any approach to the bag 10 when hung. The positioning of the reflective means places a suspending loop 24, 26 in approximate vertical alignment with each reflective element. When the bag is suspended from loops 24, 26, the disposition of the reflective elements with respect to the loops tends to maintain the reflective elements in positions for good display.

The reflective ribbons are preferred to be loops. A loop tends to remain in extended position rather than folding against the bag where the reflective properties might be hidden. Further, sewing a loop into a seam holds the loop in extended position and discourages folding against the panels of the bag. Loops provide the additional advantage of providing an attachment point where a tag 34, FIG. 2, can be attached, if desired. A supplementary loop 36 can be incorporated into the seam 20 to provide an additional attachment point for a tag or tie. Loop 36 may be a trademark label or blank tag that allows the user to apply his own marking, such as with a pen.

As described, the game bag 10 can serve as a storage apparatus for any type of game, including fish and fowl. The bag is portable and available in multiple sizes, such that the hunter or fisherman can select an appropriate size for his intended animal. In any selected size, it can be brought to camp, carried on a hunt, taken to a shooting blind, and carried to a fishing location in order to be available wherever the game is harvested. The bag is an aid to transporting the game to camp and later to an ultimate destination. While at camp, the bag contains and stores game and protects it from dirt, debris, insects, insect larva, and other contaminants.

The cord loops 24, 26 are functional for hanging the wet bag to dry and for assisting the user to conveniently open the bag. The loops 24, 26 provide a convenient attachment point for an identification tag 34, which is used to identify the unit contents and ownership. A tag wire, string, cable tie, or the like are typical tag attaching devices for an identification tag. The bag 10 is sealed by placing the tag attaching device through the two loops and closing the tag attaching device. The bag remains sealed by the tag attaching device until it is removed by a butcher or owner to access the contents.

In an example of use where the harvested game is a moose, first internal organs and hide are removed. Next, the carcass is divided into single leg portions, two, three and four parts in addition to parts such as neck meat back strap etc. Each part is placed in a separate bag. The bags aid the user in removing and transporting the animal parts from the location of harvest to the campsite and later to a location more convenient for processing, i.e., butchering. At the campsite, the bagged pieces are placed a distance away from the campsite, for safety from predators. In the evening, the hunters may check the stored bags. The hunter checks by turning on a flashlight or other light producing apparatus and shining the light in the direction of the bags from a safe distance away. The hunter can see that all is well by a clear, undisturbed reflection from the two reflective ribbons 30, 32. If a predator has attacked the bagged game, the reflective ribbons may be swaying with the bag or the bag may be on the ground, which the hunter can readily determine from the safe distance. The ribbons are similarly helpful during the daylight hours due to their bright fluorescent color.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A game bag for storing and transporting game or meat, comprising:

front and back fabric panels joined along opposite first and second side edges and a bottom edge, defining an internal cavity with an open top providing access for inserting and removing contents;

a drawstring passage formed in said front and back panels, juxtaposed to said open top for receiving a drawstring to selectively open and close the top by interaction with said drawstring passage, and defining a passage opening;

a drawstring engaged in said drawstring passage and extending from said passage opening for selectively closing the open top;

first and second sealing loops attached near the open top at opposite sides thereof;

wherein:

said drawstring passage is formed by a folded over top edge of said front and back fabric panels;

said folded over top edge is stitched against the respective panel to define the drawstring passage;

said first sealing loop is attached to the front fabric panel by being sewn into said stitching of the drawstring passage on the front panel in a position juxtaposed to said first side edge;

said second sealing loop is attached to the back fabric panel by being sewn into said stitching of the drawstring passage on the back panel in a position juxtaposed to said second side edge;

and further comprising:

a first light reflective member carried in the stitching of the second side edge below said second sealing loop for providing reflection at night; and a second light reflective member carried in the stitching of the bottom edge near said first side edge and below said first sealing loop for providing reflection at night;

whereby the game bag is suspendable from the first and second sealing loops with the first and second side edges and first and second light reflective members in approximate vertical alignment with a sealing loop.

2. The game bag according to claim 1, wherein:

said drawstring passage is formed by a folded over top edge of said front and back fabric panels;

said folded over top edge is stitched against the respective panel to define the drawstring passage;

said first sealing loop is attached to the front fabric panel by being sewn into said stitching of the drawstring passage on the front panel in a position juxtaposed to said first side edge;

said second sealing loop is attached to the back fabric panel by being sewn into said stitching of the drawstring passage on the back panel in a position juxtaposed to said second side edge;

whereby the game bag is suspendable from the first and second sealing loops with tendency to draw together the front and back panels of the bag.

3. The game bag according to claim 2, wherein at least one of said first and second light reflective members is configured in a loop.

4. An improved game bag for storing and transporting game or meat, of a type having the structure of a drawstring bag formed of front and back fabric panels assembled to define an internal cavity with an open top providing access for inserting and removing contents; a drawstring passage formed at said open top for receiving a drawstring to selectively open and close the open top by interaction with said drawstring passage, and defining a passage opening; and a drawstring engaged in said drawstring passage and extending from said passage opening for selectively closing the top, wherein the improvement comprises:

first and second sealing loops attached with each on at opposite side of the open top by junction to the drawstring passage, and of suitable size whereby a closing element can be strung through said sealing loops to draw together the sealing loops to seal shut the selectively closed top; and wherein:

said front and back fabric panels define opposite first and second side edges and a bottom edge;

said first sealing loop is carried juxtaposed to said first side edge, and said second sealing loop is carried juxtaposed to said second side edge;

a first light reflective member is attached at said second side edge below said second sealing loop for providing a first source of reflection at night; and a second light reflective member is attached at the bottom edge near said first side edge and below said first sealing loop for providing a second source of reflection at night.

5. The game bag according to claim 4, wherein said first light reflective member is configured in a loop.

6. The game bag according to claim 4, wherein said second light reflective member is configured in a loop.

7. The game bag according to claim 4, wherein:

said first and second light reflective members are florescent for providing high visibility by day.

* * * * *